United States Patent [19]

Heinlein

[11] Patent Number: 4,501,373

[45] Date of Patent: Feb. 26, 1985

[54] CLOSURE CAP, IN PARTICULAR FOR BOTTLE-LIKE CONTAINERS, HAVING AN ELEMENT ASSURING INTACTNESS

[76] Inventor: Hans Heinlein, Dombühlstrasse 33, D-8801 Schillingsfürst, Fed. Rep. of Germany

[21] Appl. No.: 449,752

[22] Filed: Dec. 14, 1982

[30] Foreign Application Priority Data

Sep. 11, 1982 [DE] Fed. Rep. of Germany ..... 3233805

[51] Int. Cl.[3] ..... B65D 41/34

[52] U.S. Cl. ..... 215/252; 215/253; 215/258; 220/265

[58] Field of Search ..... 215/251, 252, 256, 258; 220/265

[56] References Cited

U.S. PATENT DOCUMENTS

| | | | |
|---|---|---|---|
| 2,153,426 | 4/1939 | McNamara et al. | 215/252 |
| 4,081,097 | 3/1978 | Dold | 215/252 |
| 4,346,811 | 8/1982 | Hilaire | 215/252 |
| 4,352,436 | 10/1982 | Chartier | 215/252 |
| 4,372,456 | 2/1983 | Guala | 215/252 |

*Primary Examiner*—Joseph Man-Fu Moy

*Attorney, Agent, or Firm*—Browdy and Neimark

[57] ABSTRACT

A closure cap, in particular for bottle-like containers, having an element assuring intactness, which is connected by tear strips with a cap portion and remains on the container after the closure has been opened for the first time by tearing the tear strips, characterized in that a separation seam separating the element assuring intactness from the cap portion has a first set of alternating segments disposed in zigzag fashion periodically about the circumference of the element insuring intactness and additionally has a second set of alternating segments similar to said first set and carried by the cap portion. The first and second sets of segments mesh with each other. Tear strips are carried by the cap jacket between the element insuring intactness and the cap portion. The first and second sets of segments mesh with one another and serve as a coupling means during closure. The segments of the separation seam may be embodied in a plurality of forms including an undulating form; a sawtooth-like form; in quadrilateral, square or rectangular form; a semitrapezoidal form; and a trapezoidal form.

11 Claims, 6 Drawing Figures

CLOSURE CAP, IN PARTICULAR FOR BOTTLE-LIKE CONTAINERS, HAVING AN ELEMENT ASSURING INTACTNESS

FIELD OF THE INVENTION

The invention relates to a closure cap, in particular for bottle-like containers, which has an element that assures intactness; the element is connected to a cap portion by tear strips and remains on the container when the closure is opened for the first time by tearing off the tear strip.

BACKGROUND OF THE INVENTION

There is frequently a need to determine whether a container, for instance one containing medicine, tablets or the like, has been previously opened. Many closures assuring intactness are already known for this purpose. In principle, an element insuring intactness is always provided, such that in the original state of the closure cap the element is firmly connected with the rest of the cap, then being separated from it when the cap is unscrewed from the associated bottle for the first time at predetermined separation points. In most cases, a reduction in wall thickness or a perforation through the cap wall is provided, so that axially parallel or radial tear strips remain.

The closure caps are placed on the associated containers with the aid of closure machines, which have closing heads that surround the closure cap and press or screw the cap onto the container when rotated appropriately, thus closing the containers.

The predetermined separation points or tear strips must accordingly be strong enough to withstand the forces exerted during the closure process (the process of screwing the caps onto the containers). Otherwise, a separation of the closure cap and the element assuring intactness would take place as the container is being closed, rather than when the container is opened for the first time.

Closure machines have become known in recent years which operate at a highly elevated speed of rotation. As a result, the forces (torque) exerted upon the predetermined separation points or tear strips are greatly increased, and the previously known closure caps having elements assuring intactness cannot be processed on such closure machines.

SUMMARY OF THE INVENTION

It is accordingly the object of the present invention to create a closure cap with an element assuring intactness which withstands the closure or screwing process undamaged even with high-speed closure machines.

This object is attained according to the invention substantially in that a separation seam separating the element assuring intactness from the cap portion has segments which change course in zigzag fashion periodically around the circumference, and that tear strips are provided on the inside of the cap jacket between the element assuring intactness and the cap portion, the interlocking segments acting as a coupler means during the closure process.

According to a further exemplary embodiment of the invention, the alternating segments of the separation seam are embodied as quadrilateral (square or rectangular) segments. Here, again, the axially parallel forward edge of the segments brings about a firm coupling effect when the closure cap is applied to the container.

In a further modification of the invention, the separation seam may be made up of semitrapezoidal segments. It is then advantageous if the semitrapezoidal segments each have one axially parallel forward edge and an obliquely falling rear edge, viewed with respect to the direction of rotation. As a result of such an embodiment, it is again attained that the axially parallel forward edges effect a firm coupling during the screwing or closure process, while during unscrewing or opening of the closure, there is a sliding effect on the obliquely falling rear edges, thus necessarily increasing the axial length until the tear strips separate.

Instead of the semitrapezoidal segments, trapezoidal segments may also be provided, in accordance with a further exemplary embodiment of the invention.

Further details, characteristics and advantages of the invention will be discussed further, referring to the drawing, which schematically illustrates exemplary embodiments of the invention.

In the embodiment according to the invention, because of the individual segments, a carrier or coupling effect of the individual segments with one another takes place when the closure is applied to or screwed onto the container, so that the tear strips will not be stressed beyond their tear resistance in the process.

The invention can be realized in various embodiments.

In accordance with a first exemplary embodiment, the separation seam is embodied with an undulating form.

It is particularly efficacious if the separation seam has sawtooth-like segments, as provided in a further exemplary embodiment of the invention. As a result of the triangular shape of the segments, the coupling effect is achieved in one direction of rotation, while a sliding effect is obtained in the other direction of rotation.

In this exemplary embodiment it is particularly efficacious if the sawtooth-like segments of the separation seam each have one steep forward edge, in the screwing direction, which is followed by a flat, falling edge.

In this exemplary embodiment, when the cap is screwed onto the container a firm coupling of the element assuring intactness is attained by means of the steeply rising forward edge of the sawtooth-like segments, while during the unscrewing process (when the closure is opened) the flat edges slide on one another, thus increasing the axial length of the closure cap and causing stretching and finally tearing of the tear strips.

DESCRIPTION OF THE PREFERRED EMBODIMENTS

Figure 1:
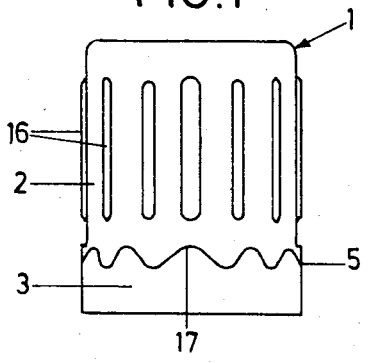
FIG. 1, in a side view, schematically shows a first exemplary embodiment having an undulating separation seam.

In FIG. 1, a first exemplary embodiment of a cap 1 according to the invention is shown. An element assuring intactness 3 is connected with an upper cap portion 2 via a separation seam 5 embodied in the form of a wavy line 17. The wave form 17 may have a sinusoidal course, as shown, or may also comprise unilateral wave halves (not shown).

Figure 2:
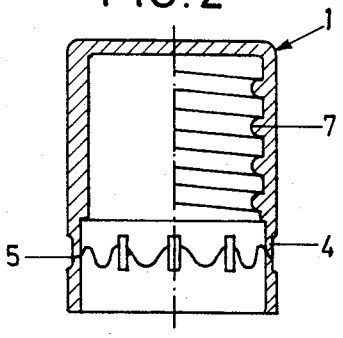
FIG. 2 is an axial section taken through an exemplary embodiment according to FIG. 1.

FIG. 2 is a sectional view of the exemplary embodiment of FIG. 1, in which the cap 1 is embodied on the left-hand side of the drawing as a push-on type cap which is clamped onto the associated mouth of a bottle-like container. On the right-hand side of the drawing, a modified exemplary embodiment is shown, in which the closure cap 1 has an internal thread 7 for connecting it with an external thread on the associated bottle-like container.

In the schematic illustration of FIG. 2 it is indicated that in the vicinity of the separation seam 5, tear strips 4 which preferably protrude inward, or wall parts cut out of the separation seam 5, are provided by use of an appropriate cutting tool. Use of an appropriate cutting tool makes it possible for the strips 4 to be embodied by wall portions pressed inward into the interior of the cap 1.

Figure 3:
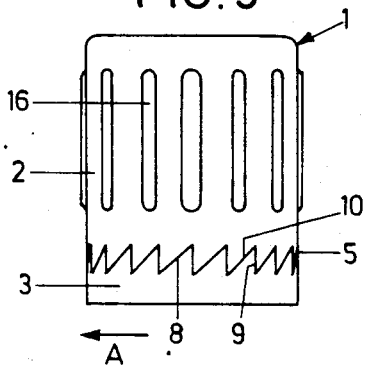
FIG. 3 shows an exemplary embodiment having a sawtooth-like separation seam.

In the exemplary embodiment according to FIG. 3, the separation seam 5 has sawtooth-like segments 8. The embodiment is preferably selected such that the sawtooth-like segments 8 have a steep, substantially axially parallel forward edge 9 with respect to the direction in which the cap is screwed on as indicated by the arrow A; this forward edge 9 is adjoined by a flat, inclined edge 10. As a result, the forward edge 9 of the upper sawtooth-like segment of the cap portion 2 exerts a coupling effect on the corresponding, axially parallel segment of the lower sawtooth of the element assuring intactness 3. When the closure is opened, that is, when the cap 2 is twisted off the container, the various flat edges 10 slide on one another, causing an increase in the axial length between the upper portion of the cap 1 and the lower edge of the element assuring intactness 3. As a result, the tear strips 4 are stretched to such an extent that they tear off in the desired manner. The portion assuring intactness then remains on the container, even when the cap portion 2 is unscrewed, that is, when the container is opened.

Figure 4:
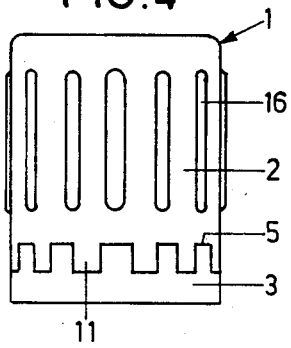
FIG. 4 shows an exemplary embodiment having a rectangular (square) embodiment of the separation seam.

In FIG. 4, a simplified exemplary embodiment is shown in which the separation seam 5 is embodied in the form of regular quadrilaterals (squares or rectangles). The coupling effect of the axially parallel forward edges is the same as in the exemplary embodiment of FIG. 3, but substantially greater forces are required for twisting back or tearing off the element assuring intactness 3 than is the case with the sawtooth-like segments 8, 9, 10 of the exemplary embodiment of FIG. 3.

Figure 5:
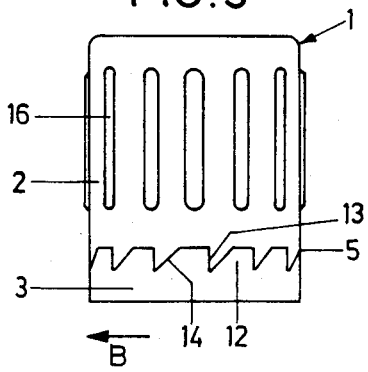
FIG. 5 shows a still further exemplary embodiment having semitrapezoidal zigzags.

In FIG. 5, a still further exemplary embodiment is shown, in which the segments of the separation seam 5 are embodied as semitrapezoidal segments, preferably with a steep or axially parallel forward edge 13 in terms of the direction of rotation of the arrow B. Here again, a coupling effect takes place between the steep forward edges of the semitrapezoidal segments 12 of the upper cap portion 2 and the correspondingly vertical parts of the semitrapezoidal segments 13 of the element assuring intactness 3 in the direction of screwing or closure. Opening or unscrewing the closure cap 1 is made easier because of the sliding of the oblique rear edges 14 on one another.

Figure 6:
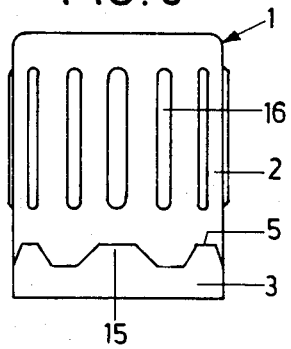
FIG. 6 shows a still further exemplary embodiment having a trapezoidal separation seam.

Finally, a further simplified exemplary embodiment analogous to that of FIG. 5 is shown in FIG. 6. The separation seam 5 here is embodied in the form of regular, trapezoidal segments 15.

The embodiment according to the invention of the separation seam 5 is independent of the embodiment of the rest of the cap 1. The cap with ribs 16 to aid in gripping is shown by way of example in FIG. 1. The cap 1 may be provided with sealing elements on the inside. The cap 1 may furthermore also be embodied for pipette bottles, having a pipetting element passing through the upper wall of the cap. The cap portion 2 may be embodied in conical fashion or with offset steps. The invention is therefore not restricted to the exemplary embodiments described and shown. It also encompasses any partial combinations or subcombinations of the characteristics and provisions described and/or shown.

What is claimed is:

1. A closure cap, in particular for bottle-like containers, having an element assuring intactness which is connected by tear strips with a cap portion and remains on the container after the closure has been opened for the first time by tearing the tear strips, characterized in that a separation seam separates said element assuring intactness from said cap portion, said seam comprising a repeating waveform-shaped weakening in a wall of the cap disposed between the cap portion and the element assuring intactness, the edge of said cap portion adjacent said weakening including a first set of oppositely directed segments, the edge of said element assuring intactness adjacent said weakening including a second set of oppositely directed segments, and said tear strips being carried by said cap between, and releasably interconnecting, said element assuring intactness and said cap portion, said first and second sets of segments meshing with one another, when said cap is rotated in a first container capping direction, for coupling said cap portion unitarily with said element assuring intactness during capping of said container, said first and second sets of segments meshing with one another, when said cap is rotated in a second direction opposite to said first direction, for uncoupling, by separating, said cap portion from said element assuring intactness by stretching and then tearing said tear strips.

2. A cap as defined by claim 1 in which said tear strips are carried by the inside of the cap jacket.

3. A cap as defined in claim 1 in which said cap is provided with reduced wall thickness in the region of said separation seam whereby to define said tear strips.

4. A cap as defined in claim 1 in which the wall of said cap is perforated in the region of said separation seam to define said tear strips.

5. A cap as defined by claim 1, characterized in that said separation seam is embodied in undulating form.

6. A cap as defined by claim 1, characterized in that said separation seam has sawtooth-like segments.

7. A cap as defined in claim 6 which is applied by a rotary turning motion and in which said sawtooth-like segments include a steep substantially axially parallel forward edge relative to the direction of turning when said cap is being positioned on the container, the forward edges of adjacent segments being joined by an inclined linear edge.

8. A cap as defined by claim 1, characterized in that said alternating segments of the separation seam are embodied as square or rectangular quadrilateral segments.

9. A cap as defined by claim 1, characterized in that said separation seam is embodied of semitrapezoidal segments.

10. A cap as defined by claim 9, which is applied to said container by a rotary turning motion and characterized in that said semitrapezoidal segments each have one axially parallel forward edge and one obliquely falling rear edge as viewed in the direction of rotation.

11. A cap as defined by claim 1, characterized in that said separation seam comprises trapezoidal segments.

* * * * *